US005725951A

United States Patent [19]

Schuette et al.

[11] Patent Number: 5,725,951

[45] Date of Patent: Mar. 10, 1998

[54] LUBRICANT AND SOIL RELEASE FINISH FOR YARNS

[75] Inventors: Robert Louis Schuette; Phillip DeMott, both of Spartanburg, S.C.; Derek Taylor, Drexel, N.C.; Angel Lee, Spartanburg, S.C.

[73] Assignee: Milliken Research Corporation, Spartanburg, S.C.

[21] Appl. No.: 520,059

[22] Filed: Aug. 28, 1995

[51] Int. Cl.[6] ..... D02G 3/00; D06M 10/00

[52] U.S. Cl. ..... 428/375; 428/386; 252/8.6; 8/115.6

[58] Field of Search ..... 428/375, 386; 252/8.6, 9; 8/115.6

[56] References Cited

U.S. PATENT DOCUMENTS

| | | | |
|---|---|---|---|
| 3,625,754 | 12/1971 | Dunn | 117/138.8 F |
| 3,775,051 | 11/1973 | Graff | 8/115.6 |
| 4,014,857 | 3/1977 | Schmoyer | 260/67.6 R |
| 4,068,035 | 1/1978 | Violland et al. | 428/279 |
| 4,107,056 | 8/1978 | Violland et al. | 252/8.8 |
| 4,131,550 | 12/1978 | Marco | 252/8.6 |
| 4,159,978 | 7/1979 | Violland et al. | 525/441 |
| 4,201,824 | 5/1980 | Violland et al. | 428/262 |
| 4,207,071 | 6/1980 | Lipowitz et al. | 8/115.6 |
| 4,283,452 | 8/1981 | Marco | 428/386 |
| 4,290,765 | 9/1981 | Sandler | 8/115.6 |
| 4,349,688 | 9/1982 | Sandler | 560/91 |
| 4,420,507 | 12/1983 | Marco | 428/386 |
| 4,427,557 | 1/1984 | Stockburger | 252/8.7 |
| 4,520,176 | 5/1985 | Martin et al. | 524/598 |
| 4,565,717 | 1/1986 | Hosegood et al. | 427/339 |
| 4,937,277 | 6/1990 | O'Lenick, Jr. | 524/318 |
| 4,973,643 | 11/1990 | O'Lenick, Jr. | 528/15 |
| 5,234,753 | 8/1993 | Williams, Jr. | 428/265 |
| 5,370,933 | 12/1994 | Govindan | 428/272 |

FOREIGN PATENT DOCUMENTS

A-458356 11/1991 European Pat. Off. .

*Primary Examiner*—Newton Edwards

*Attorney, Agent, or Firm*—Terry T. Moyer; Timothy J. Monahan

[57] ABSTRACT

An improved textile yarn finish is provided having a continuous aqueous phase with a soil release agent incorporated therein and a discontinuous phase of a lubricating oil.

7 Claims, No Drawings

LUBRICANT AND SOIL RELEASE FINISH FOR YARNS

BACKGROUND OF THE INVENTION

This invention relates to a yarn which has been treated with a lubricant and soil release finish composition prior to fabric formation, particularly to a yarn which has been treated with an oil-in-water emulsion finish.

Prior to fabric formation, synthetic yarn and yarn blends containing synthetic fibers are typically processed to provide increased strength, stretch and bulk, and to enhance their appearance. The processing steps may include heating and drawing to provide a degree of orientation to the yarns, as well as texturing with mechanical action. After the yarns have been modified as desired, a lubricant is applied to reduce friction during subsequent processing steps, such as winding, weaving or knitting.

It is well known to improve the washability and moisture transport properties of fabrics made from synthetic fibers by treating the fabric with a "soil release agent". In one example, a soil release agent, which is the condensation product of dimethyl terephthalate, ethylene glycol and polyethylene glycol, is added to the bath during jet dyeing of polyester, and the agent is exhausted into the fibers of the fabric. Following the dyeing step, the fabric is rinsed, dried and heat set.

One of the shortcomings of the prior art process is that the soil release agent is applied to the fabric during the dye cycle. Accordingly, it has been necessary to process the fabric in the dyeing equipment, even if the fabric is not going to be dyed, for the sole purpose of providing the soil release treatment. Another shortcoming is that it is that the soil release agent is applied after fabric formation. Accordingly, when the yarn is sent to different locations to be woven or knitted, or if the yarn is sold, each location is required to have its own equipment for applying the soil release agent.

SUMMARY OF THE INVENTION

Therefore, one of the objects of the invention is to provide a soil release treatment which need not be exhausted into the fabric. Another object of the invention is to provide a soil release treatment which may be applied to the yarns prior to fabric formation. Still another object of the invention is to combine application of the lubricant finish and soil release finish in a single step.

Accordingly, a finish composition is provided, which incorporates a lubricating oil and a soil release agent and is applied to a yarn as an oil-in-water emulsion. The lubricant protects the yarn during subsequent processing steps, such as winding and fabric formation. The soil release agent improves the washability and moisture transport properties of the yarn and fabrics made therefrom.

Additionally, the invention may be characterized by one or more of the following features:

yarn to yarn friction of 33 to 39 grams of output tension;

yarn to metal friction of less than 50 grams of output tension at a contact angle of 180°; and textured continuous filament polyester yarn.

Advantages of the present invention include:

a decrease in the amount of lubricant required, as the soil release agent provides lubrication to the yarn; and elimination of unnecessary process steps, since the soil release properties may be imparted to a yarn by application of a soil release agent under ambient conditions.

DETAILED DESCRIPTION OF THE INVENTION

Without limiting the scope of the invention, the preferred embodiments and features are hereinafter set forth. Unless otherwise indicated, all parts and percentages are by weight and conditions are ambient i.e. one atmosphere of pressure and 25° C. The terms aryl and arylene are intended to be limited to single and fused double ring aromatic hydrocarbons. Unless otherwise specified, aliphatic hydrocarbons are from 1 to 12 carbon atoms in length, and cycloaliphatic hydrocarbons comprise from 3 to 8 carbon atoms.

In the present invention, the soil release agent is applied to a yarn, prior to fabric formation, along with a lubricant. The yarn may be a continuous multifilament yarn or spun yarn. The yarn will typically have a denier ranging from 30–300 and have a filament count ranging from 10–200, preferably 15–100. The denier and the filament count are not deemed to be critical to the practice of the invention, and yarns outside the stated ranges may be used.

A wide variety of natural and synthetic fibers may be employed. By way of example the fiber substrate may be selected from polyamide fibers, including nylon, such as nylon 6 and nylon 6,6, and aramid fibers; polyester fibers, such as polyethylene terephthalate (PET); polyolefin fibers, such as polypropylene; polyurethane fibers; blends of the aforementioned synthetic fibers; and blends of such synthetic fibers with cellulosic fibers, such as cotton, rayon and acetate. Preferably, the fiber has a hydrophobic component and is selected from polyamide fibers, polyester fibers or polyester/cotton blends.

The finish composition applied to the yarn contains a lubricating oil to facilitate subsequent processing of the yarn, such as winding, warping and fabric formation, and a soil release agent to enhance the performance of the textile article made from the yarn. The finish composition is applied to achieve a lubricant add on, including emulsifiers necessary to form a stable emulsion, of from 0.15 to 6 wt % on the weight of the fiber (owf), preferably 0.375 to 2% owf; and a soil release agent add on of from 0.05 to 3.0% owf, preferably 0.075 to 0.75% owf.

Satisfactory results are achieved with emulsions containing 45 wt % or greater, preferably, 50 wt % or greater water and compositions having the following ranges may be employed:

1 to 49.7 wt. % of a lubricating oil;

0.3 to 49 wt. % of a soil release agent;

50 to 95 wt. % water; and up to 5 wt. % auxiliaries.

Preferably, the composition is an emulsion having from:

2.5 to 29.5 wt. % of a lubricating oil;

0.5 to 25 wt. % of a soil release agent;

70 to 95 wt. % water; and up to 3 wt. % auxiliaries. The concentration of lubricating oils is intended to include the emulsifiers necessary to form a stable emulsion of the oil.

The auxiliaries biocides, antistatic agents, anti-sling agents, and wetting agents, and their use in fiber finishes well known to those skilled in the art.

The invention may be practiced with a wide variety of conventional lubricating oils. By way of example, suitable oils include:

(a) mineral oil derivatives which include paraffinic, alicyclic and aromatic hydrocarbons and combinations thereof; the molecular weights of the mineral oils typically range from 175–1000;

(b) synthetic oils including:

(i) organic esters such as $C_6$–$C_{18}$ esters of fatty acids, particularly dibasic esters derived from $C_6$–$C_{10}$ diacids esterified with $C_6$–$C_{10}$ alcohols and esters of higher polyols such as triglycerides and esters of pentaerythritol;

(ii) alkoxylated fatty acids and alcohols, primarily propylene oxide and ethylene oxide adducts of $C_{10}$–$C_{18}$ organic acids and alcohols;

(iii) low molecular weight polyolefins, which are liquid at ambient conditions, such as polyisobutylene and polyalphaolefins; and (iv) silihydrocarbon oils.

Reference may be made to the Kirk-Othmer, *Encyclopedia of Chemical Technology*, 3rd Edition, Volume 14, page 477 et. seq. "Lubrication and Lubricants" (1981); Ross et at, U.S. Pat. No. 4,995,884; and Plonsker, U.S. Pat. No. 4,932,976.

Conventional soil release agents may be employed in the composition of the present invention. The soil release agents are characterized by a macromolecule having a hydrophilic component, such as a carboxyl, hydroxyl, alkali metal sulfonate and/or oxyethylene group, and a lipophilic component with an affinity for the fiber, which functions to add durability or to anchor the soil release agent to the fiber surface. The backbone of the macromolecule is generally formed by either vinyl polymerization or condensation reaction. Molecular weights may range from 500 to 100,000, preferably from 1,000 to 25,000, most preferably 1,000 to 10,000.

By way of example, suitable soil release agents include:

(a) non-ionic soil release agents having oxyethylene hydrophiles, such as the condensation polymers of polyethylene glycol and/or ethylene oxide addition products of acids, amines, phenols and alcohols which may be monofunctional or polyfunctional, together with binder molecules capable of reacting with the hydroxyl groups of compounds with a poly (oxyalkylene) chain, such as organic acids and esters, isocyanates, compounds with N-methyl and N-methoxy groups, bisepoxides etc. Particularly useful are the condensation products of dimethyl terphthalate, ethylene glycol and polyethylene glycol (ethoxylated polyester) and ethoxylated polyamides, especially ethoxylated polyesters and polyamides having a molecular weight of at least 500, as well as the soil release agents described in the following patents, U.S. Pat. No. 3,416,952; U.S. Pat. No. 3,660,010; U.S. Pat. No. 3,676,052, U.S. Pat. No. 3,981,807; U.S. Pat. No. 3,625,754; U.S. Pat. No. 4,014,857; U.S. Pat. No. 4,207,071; U.S. Pat. NO. 4,290,765; U.S. Pat. No. 4,068,035 and U.S. Pat. No. 4,937,277.

(b) anionic soil release agents particularly, vinyl polymers containing carboxylic acid as the hydrophile as can be obtained by polymerizing acrylic acid, methacrylic acid or maleic acid, usually with a comonomer such as an alkyl acrylate, preferably methyl or ethyl acrylate, to increase the lipophilic character of the polymer and to decrease brittleness. Cross-linking improves the durability of the soil release agent, and accordingly, it is desirable to copolymerize with a cross-linking agent such as N-methyl acrylamide, or to cross-link the polymer with a small amount of a bisepoxide. Examples of representative anionic soil release agents may be found in the following patents: U.S. Pat. No. 3,377,249; U.S. Pat. No. 3,535,141; U.S. Pat. No. 3,540,835; U.S. Pat. No. 3,563,795; U.S. Pat. No. 3,598,641; U.S. Pat. No. 3,574,620; U.S. Pat. No. 3,632,420; U.S. Pat. No. 3,650,801; U.S. Pat. No. 3,652,212; U.S. Pat. No. 3,690,942; U.S. Pat. No. 3,897,206; U.S. Pat. No. 4,090,844; and U.S. Pat. No. 4,131,550.

(c) combinations of anionic soil release agents with oxyethylene hydrophile condensates, such as are generally referred to as sulfonated ethoxylated polyesters and the soil release agents disclosed in the following patents: U.S. Pat. No. 3,649,165; U.S. Pat. No. 4,073,993; and U.S. Pat. No. 4,427,557.

(d) nonionic soil release agents with hydroxyl hydrophiles, particularly cellulose derivatives such as cellulose acetate and the soil release agents disclosed in the following patents: U.S. Pat. No. 3,620,826; U.S. Pat. No. 4,164,392; and U.S. Pat. No. 4,168,954.

The soil release agent may be in the form of an emulsion, dispersion or solution. Preferably, the soil release agent has a nonionic hydrophilic component and is in the form of an aqueous dispersion or aqueous solution.

All of the United States patents heretofore listed are incorporated by reference herein.

The lubricating oil and soil release agent are combined, along with the desired ancillary additives, to form an oil-in-water emulsion using conventional techniques. Preferably, the soil release agent is in the form of an aqueous dispersion, solution or emulsion, as are commercially available. For example, first an emulsion of the lubricant and water is formed by vigorous agitation with a laboratory stirrer, and next, the soil release agent may be added while continuing to agitate the composition. It may be desirable to improve the stability of the emulsion by incorporating surface active agents (surfactants) or emulsifiers into the composition, as is well known to those skilled in the art. Suitable emulsifiers include nonionic, ionic and zwitterionic surfactants, such as alkoxylated alcohols, alkyl phenols, fatty acids and amides; carboxylate, sulfonates and phosphate esters, quaternary compounds and those surfactants disclosed in the *Kirk-Othmer Encyclopedia of Chemical Technology*, 3rd Edition, Surfactants and Detersive Systems, pp. 332–432 (1983). If an emulsifier is necessary to stabilize the finish composition, the emulsifier may be employed at a ratio of emulsifier to oil of from about 1:20 to 2:1, preferably 1:10 to 1:1.

The lubricant/soil release finish composition may be applied at any stage of yarn processing that a lubricant alone could be applied. Prior to application of the finish, the yarn may be subjected to various treatments, such as one or more of the following: drawing, twisting, heat setting, entanglement or crimping. In a preferred embodiment, the finish is applied at the texturing frame to textured polyester yarn made from drawn partially oriented yarn (POY).

The finish may be applied by conventional techniques used to apply a lubricant emulsion to yarn. By way of example, the finish of the present invention may be applied from a kiss roll, metered applicator, sprayer, or by immersion. The add on of finish composition (as is) ranges from 1 to 30 wt. % owf, preferably from 3 to 15 wt. % owf, most preferably from 3 to 8 wt% owf.

Following application of the present finish to the yarn, the yarn may be handled and processed as are yarns treated with conventional lubricants. For example, the yarn may be wound into a package and then formed into a fabric, preferably a woven knitted fabric, as is well known in the art. The yarn or fabric may be scoured, heat set and even dyed. One of the advantages of the present process is that it is particularly useful when the yarn or fabric is not dyed.

Since the soil release agent is applied early in the yarn processing process, the dyeing step can be eliminated when it is desirable to do so. Surprisingly, the performance and durability of the soil release treatment is not adversely affected by omission of the dyeing step, or other treatment in a heated aqueous bath, which was once thought necessary to exhaust the soil release agent into the fiber, before soil release properties could be achieved.

The invention may be further understood by reference to the following examples, but the invention is not to be construed as being unduly limited thereby.

EXAMPLE 1

The following example demonstrates the washability and moisture transport performance of a fabric constructed of yarn, which has been treated with the lubricant/soil release agent emulsion of the present invention.

A partially oriented polyester yarn, 150/34, was heated, drawn and textured. At the texturing frame, a lubricant/soil release agent finish was applied in emulsion form to the yarn to achieve 1 wt %, 2 wt % or 3 wt % (owf), on a neat basis. The composition of the finish was 3.2 wt % of an ethoxylated polyester soil release agent identified as lubril QCX™ available from Rhone Polenc; 20 wt % of an emulsified ester lubricant, identified as Synlube™ 6340 available from Milliken Chemical, U.S.A.; and 76.8 wt % water.

For each level of finish, the yarn was knitted into a sock and the sock was cut in half. One half of the sock was scoured in a 120° F. home wash (12 minute "cotton/sturdy" wash cycle in a residential washing machine with detergent present). The scoured and unscoured halves of fabric, Samples A and B, respectively, were then dyed blue (Resolin Blue GFL) in a disperse dye cycle (130° C. for 30 minutes) on a Mathis laboratory jet dyeing machine.

The fabrics were then tested for soil release using corn oil according to AATCC Test Method 130-1977, and moisture transport according to AATCC Test Method 39-1977. The soil release test is designed to measure the ability of a fabric to release oily stains during home laundering. Briefly, a sample fabric is stained with corn oil and washed under conventional home laundry conditions. The samples are then rated on a scale from 1–5, with 1 representing the poorest stain removal and 5 representing the best stain removal.

The moisture transport or wettability test measures the time it takes for a fabric to absorb a drop of water, while the fabric is held taut and horizontal. The time it takes for the drop to completely absorb into the fabric is measured in seconds, with a stop watch, and recorded. A high number is indicative of slow absorption, and thus poor wettability. The fabric made from yarn treated with the lubricant/soil release agent finish of the present invention were compared to fabrics made from yarn treated with a lubricant finish only, which was knitted, cut in half and one half only was scoured, Samples C and D. The results for 1 wt % (owf) finish levels are reported in Table 1.

TABLE 1

| Sample | Finish Treatment | Finish Level | Scour? | Soil Release Rating (1–5) | Wettability (Seconds) |
|---|---|---|---|---|---|
| A | lubricant/soil release agent | 1 wt % (owf) | scour | 4.5 | 1 |
| B | lubricant/soil release agent | 1 wt % (owf) | no scour | 4.8 | 1 |
| C | lubricant | 1 wt % | scour | 2.8 | >30 |

TABLE 1-continued

| Sample | Finish Treatment | Finish Level | Scour? | Soil Release Rating (1–5) | Wettability (Seconds) |
|---|---|---|---|---|---|
| D | lubricant | (owf) 1 wt % (owf) | no scour | 3.0 | >30 |

EXAMPLE 2

The procedures of Example 1 were repeated except that an equal amount of an emulsified hydrocarbon lubricant, identified as Lube Stat™ 5101 available from Milliken Chemical, U.S.A., was substituted for the lubricant in the lubricant/soil release agent finish. The results of finish applications at 1 wt %, 2 wt % and 3 wt % (owf), on a neat basis, are reported below in Table 2.

EXAMPLE 3

The procedures of Example 1 were repeated except that an alkoxylated lubricant, identified as Syn Lube™ 6278, available from Milliken Chemical, U.S.A., was substituted for the lubricant in the lubricant/soil release agent finish. The results of finish applications at 1 wt %, 2 wt % and 3 wt % (owf), on a neat basis, are reported below in Table 2.

TABLE 2

| Finish Composition (Sample) | Add On (owf) | Soil Release Rating (1–5) |
|---|---|---|
| Example 1 (Sample A) | 1 wt % | 4.5 |
| | 2 wt % | 5.0 |
| | 3 wt % | 4.8 |
| Example 2 | 1 wt % | 5.0 |
| | 2 wt % | 5.0 |
| | 3 wt % | 5.0 |
| Example 3 | 1 wt % | 5.0 |
| | 2 wt % | 5.0 |
| | 3 wt % | 5.0 |

EXAMPLE 4

The following example shows variation of the relative proportion of lubricant, soil release agent in water, and the affect the variation has on friction and soil release properties.

The procedures of Example 1 were repeated, except that the components of the lubricant/soil release agent finish of Example 1 was varied as shown in Table 3 below, and designated E, F and G. Also included in Table 3 are the test results for Sample A of Example 1, and the test results for a control yarn which had been treated with a producer supplied primary lubricant finish at approximately 0.3 wt % owf.

Yarn-to-metal and yarn-to-yarn friction was evaluated using a Rothschild frictometer. The finish composition was applied to 150 denier/34 filament, textured polyester yarn, at a conventional texturing frame, at the level specified. The yarn was allowed to condition for at least 24 hours at 72° F. and 63% humidity. After conditioning, the hydrodynamic yarn-to-metal friction was obtained on the frictometer at a speed of 100 meters/minute at a contact angel of 180° and pre-tensions of 20 grams. Yarn-to-yarn friction was evaluated at the above conditions, with the exception that the friction pin was bypassed and the yarn was given two full twists.

TABLE 3

| Sample | Add On (owf) | Lubricant (wt %) | Soil Release Agent (wt %) | Water (wt %) | Yarn to Yarn Friction | Yarn to Metal Friction | Soil Release (1 poorest–5 best) |
|---|---|---|---|---|---|---|---|
| A | 1 wt % | 20 | 3.2 | 76.8 | 33 | 33.5 | 4.5 |
| | 2 wt % | 20 | 3.2 | 76.8 | 31 | 26.5 | 5 |
| | 3 wt % | 20 | 3.2 | 76.8 | 32 | 26.5 | 4.8 |
| E | 1 wt % | 15 | 3.75 | 81.25 | 40 | 47 | 5 |
| | 2 wt % | 15 | 3.75 | 81.25 | 34 | 31 | 5 |
| | 3 wt % | 15 | 3.75 | 81.25 | 33 | 28.5 | 5 |
| F | 1 wt % | 10 | 4.5 | 85.5 | 38 | 44.5 | 5 |
| | 2 wt % | 10 | 4.5 | 85.5 | 33 | 33.5 | 5 |
| | 3 wt % | 10 | 4.5 | 85.5 | 33 | 29.5 | 5 |
| G | 1 wt % | 5 | 5.3 | 89.7 | 36 | 44.5 | 5 |
| | 2 wt % | 5 | 5.3 | 89.7 | 34 | 34.5 | 5 |
| | 3 wt % | 5 | 5.3 | 89.7 | 34 | 31.5 | 5 |
| Control | — | — | — | — | 42.5 | 34.5 | 1 |

EXAMPLE 5

The following example demonstrates the efficacy of the lubricant/soil release composition on an undyed textile.

The lubricant/soil release composition of Sample A and G were applied at levels of 1, 2 or 4 wt % (owf), on a neat basis, to a polyester yarn, 150/34, made from recycled polyethylene terephthalate fiber.

The treated yarn was then knitted into a sock and test for soil release according to AATCC Test Method 130-1977. The results were compared against a control fabric made with yarn to which only a primary finish had been applied, i.e. lubricant only at about 1 wt % (owf) on a neat basis. The results are summarized below in Table 4, with a Soil Release Rating of "5" being the best and "1" being the poorest.

TABLE 4

| Sample | Add On (owf) | Soil Release (1–5) |
|---|---|---|
| Control | Primary Finish Only | 3.0 |
| A | 1% | 3.5 |
| A | 2% | 4.5 |
| A | 4% | 5.0 |
| G | 1% | 3.5 |
| G | 2% | 5.0 |
| G | 4% | 5.0 |

There are, of course, many alternative embodiments and modifications of the invention which are intended to be included within the scope of the following claims.

What we claim is:

1. A lubricated textile yarn comprising a textile yarn which has not been formed into a fabric and a finish applied to the yarn as an oil-in-water emulsion having a continuous aqueous phase having a soft release agent incorporated therein, and a discontinuous phase comprised of a lubricating oil, wherein the soil release agent is present on the yarn at an add on of from 0.05 to 3 wt. % owf and the lubricating oil is present on the yarn at an add on of from 0.15 to 6 wt. % owf, and wherein the emulsion comprises at least 45 wt. % water.

2. The textile yarn of claim 1 wherein the yarn comprises fibers selected from the group consisting of polyester, polyamide and polyolefin fibers.

3. The textile yarn of claim 2 wherein the lubricating oil is selected from the group consisting of mineral oils, organic esters, alkoxylated fatty acids and alcohols, and low molecular weight polyolefins; and the soil release agent is a macromolecule having a backbone formed by vinyl polymerization or condensation reaction, having a hydrophilic component selected from the group consisting of carboxyl, hydroxyl, alkali metal sulfonate and oxyethylene functionalities, and lipophilic component with an affinity for the fibers of the yarn.

4. The textile yarn of claim 3 wherein the yarn is a textured polyester yarn and the yarn has a yarn to yarn output tension of 33 to 39 grams and a yarn to metal output tension of less than 50 grams at a contact angle of 180 degrees using a Rothschild frictometer.

5. The textile yarn of claim 2 wherein the lubricating oil is selected from the group consisting of mineral oils, organic esters, alkoxylated fatty acids and alcohols, and low molecular weight polyolefins; and the soil release agent is an ethoxylated polyester having a molecular weight of from 1,000 to 10,000.

6. The textile yarn of claim 5 wherein the add on of the lubricating oil is from 0.375 to 2 wt. % owf and the add on of the soil release agent is from 0.075 to 0.75 wt % owf.

7. The textile yarn of claim 6 wherein the yarn is a textured polyester yarn which is knitted or woven to form a fabric and the fabric, in an undyed state, has a soil release according to AATCC Test Method 130-1977 of 3.5 or greater and a moisture transport according to AATCC Test Method 39-1977 of 10 seconds or less.

* * * * *

UNITED STATES PATENT AND TRADEMARK OFFICE

CERTIFICATE OF CORRECTION

PATENT NO. : 5,725,951

DATED : March 10, 1998

INVENTOR(S) : Schuette et al.

It is certified that error appears in the above-indentified patent and that said Letters Patent is hereby corrected as shown below:

Column 7, line 50 - substitute the word "soil" in place of the word "soft".

Signed and Sealed this

Fifth Day of May, 1998

Bruce Lehman

*Attest:*

BRUCE LEHMAN

*Attesting Officer*

*Commissioner of Patents and Trademarks*